United States Patent [19]

Krone

[11] Patent Number: 4,968,365

[45] Date of Patent: Nov. 6, 1990

[54] PYROTECHNICAL MIXTURE FOR PRODUCING A SMOKE SCREEN

[75] Inventor: Uwe Krone, Hamfelde, Fed. Rep. of Germany

[73] Assignee: Rheinmetall GmbH, Düsseldorf, Fed. Rep. of Germany

[21] Appl. No.: 350,737

[22] PCT Filed: May 5, 1988

[86] PCT No.: PCT/EP88/00378

§ 371 Date: Apr. 26, 1989

§ 102(e) Date: Apr. 26, 1989

[87] PCT Pub. No.: WO89/01926

PCT Pub. Date: Mar. 9, 1989

[30] Foreign Application Priority Data

Aug. 26, 1987 [DE] Fed. Rep. of Germany ..... 3728380

[51] Int. Cl.[5] ..... C06B 33/14

[52] U.S. Cl. ..... 149/41; 149/42; 149/43; 149/44; 149/61; 149/70; 149/77; 149/83; 102/334

[58] Field of Search ..... 149/70, 61, 41, 77, 149/42, 83, 43, 44; 102/334

[56] References Cited

U.S. PATENT DOCUMENTS

| | | | |
|---|---|---|---|
| H232 | 3/1987 | Selzer | 149/30 |
| H233 | 3/1987 | Tracy | 149/83 |
| H705 | 11/1989 | Selzer et al. | 149/61 |
| 1,461,646 | 7/1923 | French et al. | 149/61 |
| 2,995,526 | 8/1961 | DeMent | 252/305 |
| 3,274,035 | 9/1966 | Burkardt et al. | 149/40 |
| 3,862,866 | 1/1975 | Timmerman et al. | 149/21 |
| 4,100,102 | 7/1978 | Shaffer | 149/87 |
| 4,435,233 | 3/1984 | Rayer et al. | 149/87 |
| 4,438,700 | 3/1984 | Knapp | 102/334 |
| 4,474,715 | 10/1984 | Weber et al. | 149/76 |
| 4,697,521 | 10/1987 | Espagnacq et al. | 149/87 |
| 4,698,108 | 10/1987 | Vega et al. | 149/87 |
| 4,724,018 | 2/1988 | Espagnacq et al. | 149/87 |
| 4,841,865 | 6/1989 | Liberman | 149/87 |

FOREIGN PATENT DOCUMENTS

| | | |
|---|---|---|
| 803645 | 2/1951 | Fed. Rep. of Germany . |
| 918196 | 8/1954 | Fed. Rep. of Germany . |
| 2743363 | 9/1977 | Fed. Rep. of Germany . |
| 2819850 | 5/1978 | Fed. Rep. of Germany . |
| 339233 | 1/1905 | France . |
| 2032588 | 5/1980 | United Kingdom . |

OTHER PUBLICATIONS

T. L. Davis, The Chemistry of Powder and Explosives, 1943, pp. 324–325.

H. Ellern, Military and Civilian Pyrotechnics, 1968, pp. 174–175.

J. A. Conkling, Chemistry of Pyrotechnics–Basic Principles and Theory, 1985, pp. 147–151.

*Primary Examiner*—Stephen J. Lechert, Jr.

*Attorney, Agent, or Firm*—Spencer & Frank

[57] ABSTRACT

A pyrotechnic mixture for producing a smoke screen includes a reduction agent comprising a light metal, at least one oxidation agent comprising potassium nitrate, combustion moderators including at least one carbonate and a nitrogen producing compound and at least one sublimable or evaporatable, smoke generating, nontoxic additive.

16 Claims, 1 Drawing Sheet

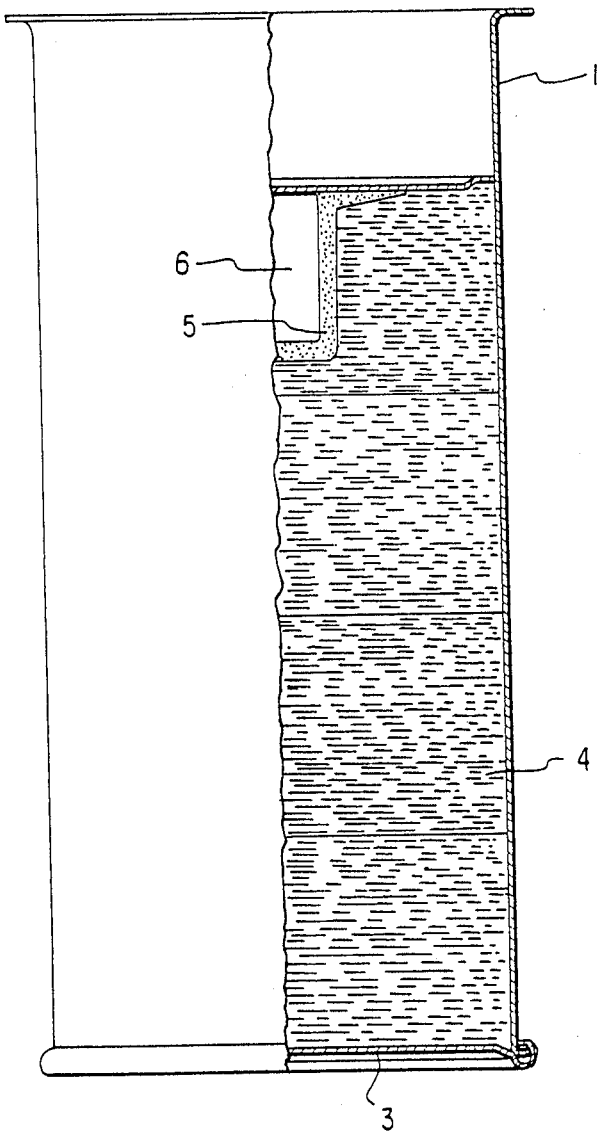
1
6
5
4
3

PYROTECHNICAL MIXTURE FOR PRODUCING A SMOKE SCREEN

BACKGROUND OF THE INVENTION

The invention relates to a pyrotechnic mixture for producing a smoke screen.

Such mixtures are known per se. Hygroscopic compounds, such as metal chlorides ($ZnCl_2$, $FeCl_3$, $AlCl_3$, $TiCl_4$, $SiCl_4$) or phosphorus oxides ($P_2O_3$, $P_2O_5$) are produced, evaporated and then hydrolyze with air to form smoke clouds suitable for camouflage. Regarding the mechanism of this method of smoke generation see H. Ellern, Military and Civilian Pyrotechnics, Chem. Publ. Comp., Inc., N.Y., 1968, pages 147–151; John A. Conkling, Chemistry of Pyrotechnics, Marcel Dekker Inc., N.Y., 1985, pages 174, 175.

Due to hydrolysis with humid air, the resulting smoke, particularly a smoke composed of hexachloroethane containing, so-called HC smoke, compositions, but also phosphorus smoke compositions, is highly acidic since it is primarily hydrochloric acid (HC smoke) or phosphorus acids (phosphorus smoke) that are formed. The smoke is therefore toxic and incompatible with plant life.

Moreover, in the smoke mixture most frequently employed which is based on hexachlorethane (HC) and zinc or zinc oxide, the heavy metal zinc is discharged into the environment.

There has been no lack of attempts to overcome these drawbacks. For example, the pyrotechnic smoke compositions disclosed in German Patents Nos. DE-PS 2,743,363 and DE-AS No. 2,819,850 are constructed in such a manner that the acid effect of the resulting smoke is partially or completely cancelled out by corresponding chemical complex formation or neutralization of the resulting $ZnCl_2$ or of the phosphorus acids. However, toxic substances that are not compatible with the environment are still generated.

SUMMARY OF THE INVENTION

It is therefore an object of the invention to provide a smoke screen which is particularly suitable for training purposes and which is composed of a nontoxic aerosol which therefore is unable to produce a toxic effect on humans and animals and, is compatible with the environment. When NaCl is not employed as an additive, the smoke is primarily composed of macronutrients suitable for plants.

A pyrotechnic mixture for producing a smoke screen, the mixture comprising:

- a reduction agent comprising magnesium powder,
- at least one oxidation agent comprising potassium nitrate,
- combustion moderators including at least one carbonate and a nitrogen producing compound and
- at least one sublimable or evaporatable, smoke generating, nontoxic additive.

The invention as described above generates a nontoxic smoke of sufficient optical density for military training purposes.

BRIEF DESCRIPTION OF THE DRAWING

The drawing FIGURE shows the mixture of the invention as used in a smoke generating device.

DESCRIPTION OF THE PREFERRED EMBODIMENTS

Smoke generation occurs in the following way: the components magnesium powder, potassium nitrate and potassium perchlorate, when converted in a range of 2500° C. will already produce smoke-like clouds. The density of the smoke is improved particularly by adding potassium chloride and/or sodium chloride whose sublimation boiling points are 1500° C. and 1450° C., respectively, far below the reaction temperature for the conversion of magnesium and potassium nitrate. The reaction products of the chemical reaction of magnesium with potassium nitrate, potassium perchlorate, calcium carbonate, etc. thus form with the sublimating potassium chloride or the evaporating sodium chloride a useful training smoke without toxic or environmentally damaging components.

The chemical reactions in the smoke composition can be represented in a simplified manner in the three equations below:

$$1.\ 2\ KNO_3 + 5\ Mg \rightarrow 5\ MgO + K_2O + N_2 + E$$

$$2.\ KClO_4 + 4\ Mg \rightarrow 4\ MgO + KCl + E$$

$$3.\ CaCO_3 + 2\ Mg \rightarrow CaO + 2\ MgO + C + E$$

The energy (E) released in the three listed basic reactions serves to sublimate/evaporate the potassium chloride and sodium chloride.

To improve combustion control, substances such as azodicarbonamide, oxamide or dicyandiamide which produce nitrogen are preferably added to the mixture. This produces a continuous gas stream for better transport of the aerosol particles and an increased aerosol yield since the permanently formed gases prevent the slag from flowing together and enhance sublimation and evaporation by an enlarged surface area.

When the mixture burns, a pure, white aerosol results which is composed primarily of the components potassium chloride, magnesium oxide, calcium hydroxide, calcium carbonate, sodium chloride and potassium carbonate. These components are compatible with the environment and nontoxic and, except for NaCl, are macronutrients for plants.

The pH of the resulting smoke is highest at the point where it is generated where is has 9 pH of 9. Chemical reactions of the oxides $K_2O$ and CaO, which are the primary oxides produced, (Equations 1, 3) with components of the air, primarily $H_2O$ and $CO_2$, form $KHCO_3$, $K_2CO_3$, $Ca(OH)_2$ and $CaCO_3$ and by dilution, cause the pH to decrease rapidly. For example, at a distance of 5 to 10 m from the source of the smoke, the pH of the ambient air reaches about 6 ($\approx 6$).

A pyrotechnic composition including the same components as the mixture for producing the smoke screen can be employed as an ignition mixture, with, however, the content of magnesium and oxidation agents being increased so as to raise ignition sensitivity and the reliability of ignition transfer. The ignition composition may be composed, for example, of the following percentages of the components: 25% Mg, 35% $KNO_3$, 10% $KClO_4$, 20% $CaCO_3$, 10% KCl.

The smoke composition and ignition composition are pressed into casings in a known manner and are caused to react by means of conventional ignition means.

The drawing figure shows one embodiment of a smoke generating body including the novel mixture. In a casing 1 having a bottom 3 there is disposed the compacted mixture 4 which is capped by a pressed-on ignition mixture 5. The embodiment of the drawing includes a recess 6 for the insertion of a known initiation means.

Preferred embodiments of the mixture are listed in the table below:

| | | |
|---|---|---|
| (a) | Mg | 15% |
| | $KNO_3$ | 30% |
| | $KClO_4$ | 0% |
| | $CaCO_3$ | 15% |
| | $KHCO_3$ | 0% |
| | KCl | 32% |
| | NaCl | 0% |
| | azodicarbonamide | 8% |
| (b) | Mg | 12% |
| | $KNO_3$ | 25% |
| | $KClO_4$ | 5% |
| | $CaCO_3$ | 18% |
| | $KHCO_3$ | 2% |
| | KCl | 30% |
| | NaCl | 0% |
| | oxamide | 8% |
| (c) | Mg | 20% |
| | $KNO_3$ | 20% |
| | $KClO_4$ | 8% |
| | $CaCO_3$ | 0% |
| | $KHCO_3$ | 12% |
| | KCl | 15% |
| | NaCl | 15% |
| | dicyandiamide | 10% |

I claim:

1. A pyrotechnic mixture for producing a smoke screen, the mixture including:
   a reduction agent comprising light metal powder,
   at least one oxidation agent comprising potassium nitrate,
   combustion moderators including at least one carbonate and a nitrogen producing compound, and
   at least one sublimable or evaporatable, smoke generating, nontoxic additive.

2. The mixture according to claim 1, wherein said at least one sublimable, smoke generating, non-toxic additive comprises potassium chloride.

3. The mixture according to claim 1, wherein the nitrogen producing compound comprises one of the compounds selected from the group consisting of azodicarbonamide ($NH_2$—CO—N=N—CO—$NH_2$), oxamide $(CONH_2)_2$ and dicyandiamide (NH=C($NH_2$)NH—CN).

4. The mixture according to claim 1 wherein:
   said reduction agent comprises Mg present at 10–25% by weight;
   said oxidation agent comprises $KNO_3$ present at 20–36% by weight and;
   said at least one carbonate comprises $CaCO_3$ present at 9–20% by weight;
   said at least one sublimable or evaporatable, smoke generating, nontoxic additive comprises at least one compound selected from the group consisting of KCl and NaCl present at 20–50% by weight; and
   said nitrogen producing compound comprising at least one compound selected from the group consisting of azodicarbonamide, oxamide and dicyandiamide present at 5–20% by weight.

5. A smoke producing device comprising:
   a smoke generating composition including:
   a reduction agent comprising Mg present at 10–25% by weight,
   an oxidizing agent comprising $KNO_3$ present at 20–36% by weight,
   a carbonate comprising $CaCO_3$ present at 9–20% by weight,
   at least one sublimable or evaporatable, smoke generating, nontoxic additive comprising at least one compound selected from the group consisting of KCl and NaCl present at 20–50% by weight, and
   a nitrogen producing compound comprising at least one compound selected from the group consisting of azodicarbonamide, oxamide and dicyandiamide present at 5–20% by weight;
   a casing for receiving said smoke generating composition; and
   an ignition mixture located at one end of said casing.

6. The smoke producing device according to claim 5, wherein said ignition mixture includes the same components as the smoke generating composition but in different quantitative amounts.

7. The mixture according to claim 1, wherein said light metal powder comprises magnesium.

8. The mixture according to claim 1, wherein said at least one evaporatable, smoke generating, non-toxic additive comprises sodium chloride.

9. The mixture according to claim 1, wherein:
   said reduction agent comprises Mg present at about 15% by weight;
   said oxidation agent comprises a mixture of $KNO_3$ present at about 25% by weight and $KClO_4$ present at about 5% by weight;
   said at least one carbonate includes a first carbonate comprising $CaCO_3$ present at about 12% by weight and a second carbonate comprising at least one of the compounds selected from the group consisting of $KHCO_3$, $NaHCO_3$, $K_2CO_3$ and $Na_2CO_3$ present at about 3% by weight;
   said at least one sublimable or evaporatable combustion moderator comprises at least one compound selected from the group consisting of KCl and NaCl present at about 30% by weight; and
   said nitrogen producing compound comprises at least one compound selected from the group consisting of azodicarbonamide, oxamide and dicyandiamide present at about 10% by weight.

10. The mixture according to claim 1, wherein said oxidation agent comprises a mixture of potassium nitrate and potassium perchlorate.

11. The mixture according to claim 1, wherein said at least one carbonate comprises a compound selected from the group consisting of calcium carbonate, potassium hydrogen carbonate, sodium hydrogen carbonate, potassium carbonate, sodium carbonate.

12. The smoke producing device according to claim 5, wherein said ignition mixture includes about 25% by weight Mg, about 35% by weight $KNO_3$, about 10% by weight $KClO_4$, about 20% by weight $CaCO_3$ and about 10% by weight KCl.

13. The mixture according to claim 4, wherein said oxidation agent further comprises $KClO_4$ present at about 5% by weight in the total mixture.

14. The mixture according to claim 4, wherein at least one said carbonate further includes a second carbonate selected from the group consisting of $KHCO_3$, $NaHCO_3$, $K_2CO_3$ and $Na_2CO_3$ present at about 3% by weight in the total mixture.

15. The smoke producing device according to claim 5, wherein said oxidation agent further comprises $KClO_4$ present at up to 5% by weight in the total mixture.

16. The smoke producing device according to claim 5, wherein said at least one carbonate further includes a second carbonate selected from the group consisting of $KHCO_3$, $NaHCO_3$, $K_2CO_3$ and $Na_2CO_3$ present at about 3% by weight in the total mixture.

* * * * *